United States Patent [19]

Sutton, III

[11] 4,375,272

[45] Mar. 1, 1983

[54] FIXED ANGLE TUBE CARRIER

[75] Inventor: John H. Sutton, III, Belmont, Calif.

[73] Assignee: Beckman Instruments, Inc., Fullerton, Calif.

[21] Appl. No.: 279,491

[22] Filed: Jul. 1, 1981

[51] Int. Cl.[3] ..... B04B 9/12; B04B 15/00

[52] U.S. Cl. ..... 494/16; 494/10

[58] Field of Search ..... 233/26, 1 R; 422/99, 422/101, 72, 104

[56] References Cited

U.S. PATENT DOCUMENTS

| | | | |
|---|---|---|---|
| 3,050,239 | 8/1962 | Williams, Jr. | 233/24 |
| 3,377,021 | 4/1968 | Fox | 233/26 |
| 3,891,140 | 6/1975 | Ayres | 233/26 |

*Primary Examiner*—Robert W. Jenkins

*Attorney, Agent, or Firm*—R. J. Steinmeyer; F. L. Mehlhoff; William H. May

[57] ABSTRACT

A fixed angle tube carrier is provided for use with externally shouldered sample tubes and a centrifuge rotor having formed therein a plurality of symmetrically disposed vertical slots in its outer peripheral surface. The slots are formed in the shape of a "T" and adapted for sliding engagement with a tube carrier. The tube carrier comprises a vertically elongated member having a "T" shaped cross-section which is adapted for sliding engagement with the slots of the rotor. The carrier contains a plurality of circular recesses which are open at each end and adapted for holding an externally shouldered sample tube. The longitudinal axis of each recess is disposed radially of the vertical axis of the rotor and at an angle less than 90° thereto.

4 Claims, 4 Drawing Figures

FIXED ANGLE TUBE CARRIER

BACKGROUND OF THE INVENTION

The present invention relates to centrifuges, and more particularly to apparatus for adapting a centrifuge rotor for fixed angle centrifugation.

Centrifuge rotors employing carrier mounted sample tubes are well known in the art. A rotor of this kind is described in U.S. Pat. No. 3,050,239 issued to Fred G. Williams and assigned to Beckman Instruments, Inc., the assignee of the present invention. The rotor described by Williams contains a plurality of elongated vertical slots in its outer periphery, each of which are adapted to receive a slide-in tube carrier. Each carrier holds a plurality of sample tubes and when the carrier is installed in the rotor, the tubes are oriented radially outward of the rotor spin axis. In other words, the tubes protrude beyond the exterior of the rotor in a fixed horizontal attitude.

A number of advantages are found in the Williams device. One of these is that the rotor can be made smaller than the radius at which centrifugation occurs, so that the rotor can be significantly smaller and lighter than a conventional rotor. As a result, the overall size and cost of the centrifuge tends to be minimized. The present invention retains the advantages of the Williams design, while at the same time providing a sample tube carrier adapted for fixed angle centrifugation; that is, centrifugation with the sample tube at an angle intermediate of the horizontal and vertical directions.

SUMMARY OF THE INVENTION

The invention provides a fixed angle tube carrier for use with externally shouldered sample tubes and a centrifuge rotor adapted to rotate about its vertical axis and having formed therein a plurality of symmetrically disposed vertical slots in its outer peripheral surface. The slots are formed in the shape of a T and adapted for sliding engagement with a tube carrier. The tube carrier comprises a vertically elongated member having a T-shaped cross section which is adapted for sliding engagement with the slots of the rotor. The carrier contains a plurality of circular recesses which are open at each end and adapted for holding an externally shouldered sample tube. The longitudinal axis of each recess is disposed radially of the vertical axis of the rotor and at an angle less than 90° thereto.

DETAILED DESCRIPTION

Figure 1:
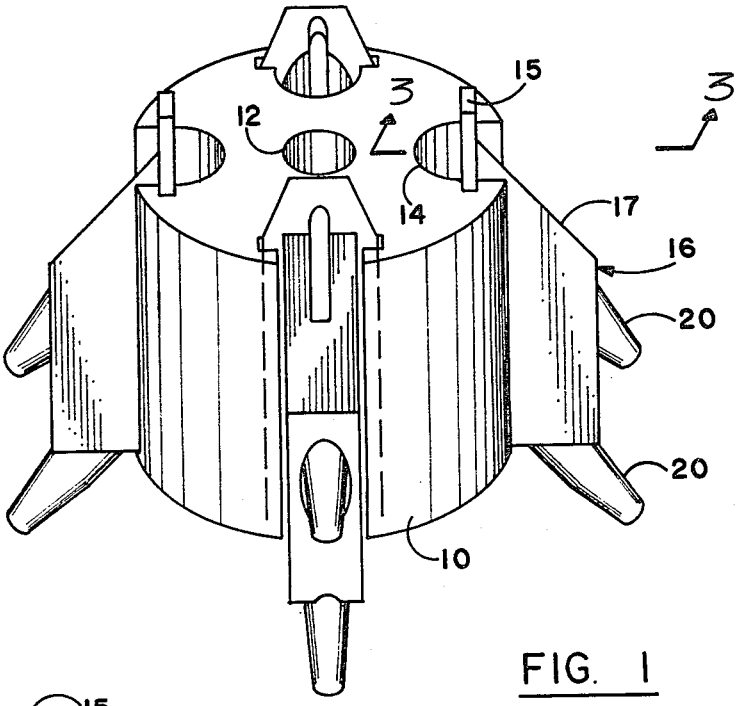
FIG. 1 is a perspective view of a rotor containing sample tube carriers constructed in accordance with the invention.

Referring initially to FIG. 1, there is shown a centrifuge rotor 10 having a generally circular configuration and adapted to rotate about its vertical axis. The rotor includes a circular mounting hole 12 and a plurality of T-shaped vertical slots 14 which are symmetrically disposed about its outer peripheral surface. Each of the slots 14 is configured to receive a tube carrier 16 in sliding engagement therewith.

Figure 2:
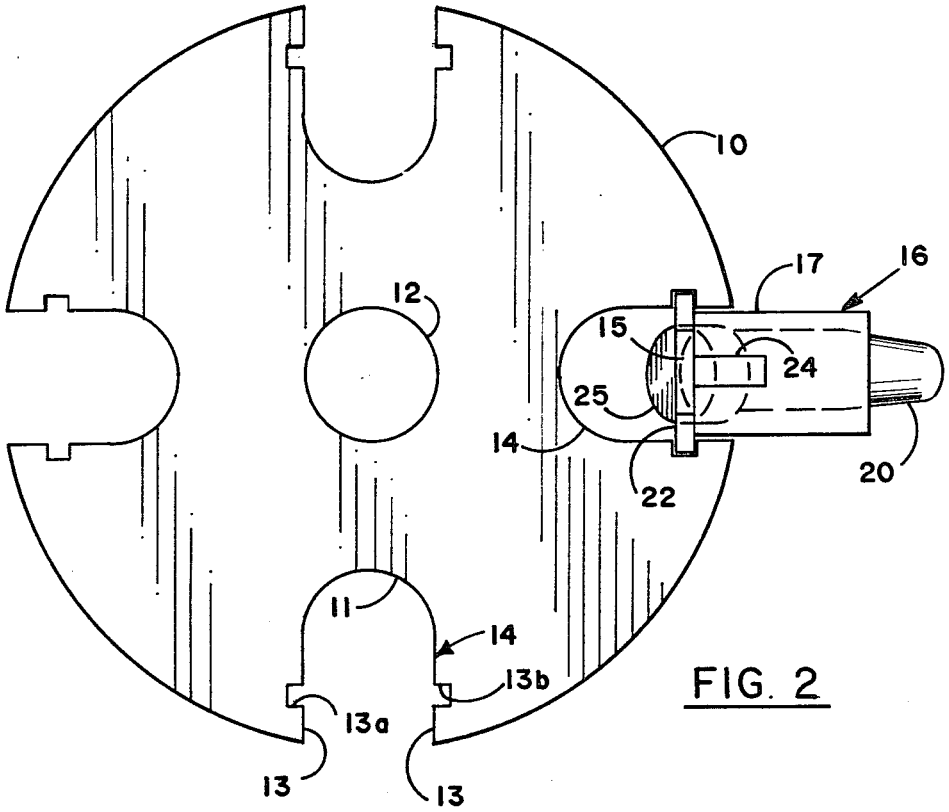
FIG. 2 is an enlarged top view of a rotor and tube carrier constructed in accordance with the invention.

Referring now to FIG. 2, there is shown a top view of the centrifuge rotor 10 with all but one of the tube carriers 16 removed. It will be seen that each of the T-shaped slots 14 in the rotor 10 comprises a first channel 13 having a radius 11 at the bottom, and the channel is undercut on opposite sides by narrower second and third channels **13*a* and 13*b* giving the slot 14 an essentially "T" configuration. It should be understood that the channel 13** can also be made with a flat bottom as shown in the previously discussed Williams patent.

With attention now directed to the sample tube carrier 16, it will be seen that the carrier has a "T" configuration as viewed from the top, and includes a body portion 17 normal to a narrower flange-like section 15. The flange-like section is designed to be slidably engaged with the undercuts **13*a* and 13*b* of a T-shaped slot 14**.

Figure 3:
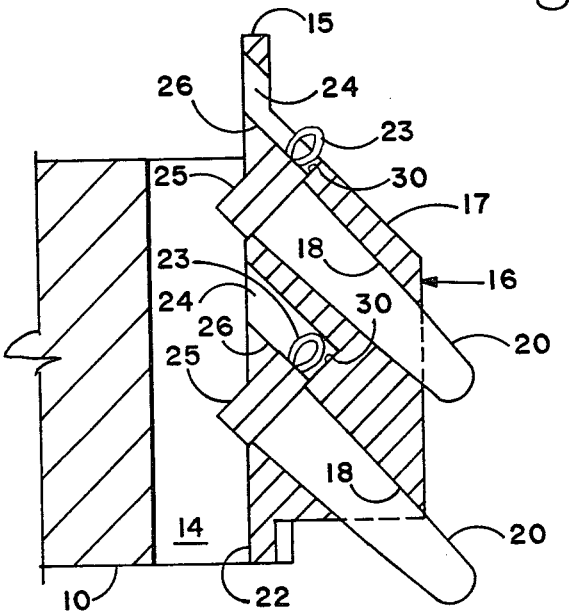
FIG. 3 is an enlarged cross-sectional view taken across line 3—3 in FIG. 1.
Figure 4:
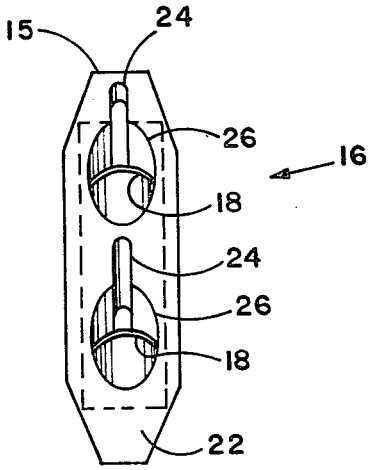
FIG. 4 is an elevational view of the inward side of the carrier of the invention.

Referring now also to FIG. 3 and FIG. 4, there is shown, respectively, a cross-sectional view of the tube carrier 16 taken across the line 3—3 of FIG. 1 and an elevation view showing the inward side 22 of the carrier with the sample tubes 20 removed. It will be seen that the carrier 16 is a vertically elongated member containing two circular recesses 18 for holding sample tubes 20. The recesses 18 are open at each end and preferably conform to the shape of the sample tube 20 in order to support the tube and prevent its being stressed excessively during centrifugation. When contained in the rotor, the longitudinal axis of the sample tube 20 is radial to the rotor's axis of rotation and at an angle less than 90° thereto. Preferably, the angle is in the range of 35° to 55°. An advantage to having the tube angle in the region of 45° is that, after centrifugation, the carrier can be removed from the rotor and then be easily oriented, so that gravity acts on the centrifuged sample in generally the same direction as the prior centrifugation force. This assures that there will be no disturbance of the sedimentation pattern by gravity when centrifugation is concluded. In this resting mode, the carrier is oriented 90° from its original orientation in the centrifuge, so that the inward side 22 of the carrier is now positioned facing upward. A simple horizontal rack having a series of spaced openings could then be used to support a plurality of carriers in the manner described after centrifugation.

In operation, the tube carriers 16 are demounted from the rotor 10 by sliding them vertically out of the slots 14 in the rotor. The carriers are then loaded by inserting a sample tube 20 into each recess 18. The insertion is accomplished from the inward side 22 of the carrier 16. In each instance, the tube is advanced in the recess 18 until the tube's shoulder 28 seats against the face 30 of the counterbore 26. In the embodiment shown, the sample tube is provided with a hinge 23 for attaching the tube cap 25 to the tube shoulder 28. Care is exercised to align the hinge 23 portion of the sample tube 20 with a longitudinal slot 24 extending the length of the counterbore 26. The hinge 23 acts as a key so that the orientation of the tube with respect to the centrifugation forces is known precisely. This enables the user to remove the sample tube from the centrifuge and then return it to centrifugation with the sedimentation pellet in exactly the same position as previously. This feature is advantageous to the user as, for example, where it is desired to interrupt the centrifugation to inspect the pellet, or where it is desired to draw off or replace the supernatent liquid. The remounting of the carrier 16 to the rotor 10 is accomplished by simply sliding the carrier into one of the vertical slots 14 of the rotor 10. Means other than the hinge 28 may be employed to index the sample tube in the carrier. For example, a key tab could be provided on the sample tube to engage the slot 24 of the carrier and thereby index the tube.

While in accordance with the patent statutes there has been described what at present is considered to be the preferred embodiment of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A tube carrier for use with externally shouldered sample tubes and a centrifuge rotor adapted to rotate about its vertical axis, said rotor having formed therein a plurality of symmetrically disposed vertical slots in its outer peripheral surface, said slots formed in the shape of a T and adapted for sliding engagement with a tube carrier, said carrier comprising:

a vertically elongated member having a T-shaped cross section adapted for sliding engagement with the slots of said rotor;

said carrier containing a plurality of circular recesses; said recesses open at each end and adapted for holding an externally shouldered sample tube;

the longitudinal axis of each said recess disposed radially of the vertical axis of said rotor and at an angle less than 90° thereto.

2. The tube carrier recited in claim 1, wherein the longitudinal axis of each said recess defines an angle of 45° with respect to the vertical axis of said rotor.

3. A tube carrier for use with externally shouldered sample tubes having indexing means and a centrifuge rotor adapted to rotate about its vertical axis and having formed therein a plurality of symmetrically disposed vertical slots in its outer peripheral surface, said slots formed in the shape of a "T" and adapted for sliding engagement with a tube carrier, said carrier comprising:

a vertically elongated member having a T-shaped cross section adapted for sliding engagement with the slots of said rotor;

a plurality of circular recesses intersecting said carrier radially of said vertical axis of said rotor and at an angle thereto;

a concentric counterbore joining each of said recesses on the side nearest said vertical axis of said rotor;

a longitudinal slot extending the length of said counterbore adapted for engagement with said indexing means of said sample tube to orient said tube on insertion into a recess.

4. The carrier of claim 3 wherein said indexing means of said sample tube comprises the hinge portion of a hinged tube cap.

* * * * *